US010730072B2

(12) United States Patent
Wang et al.

(10) Patent No.: US 10,730,072 B2
(45) Date of Patent: Aug. 4, 2020

(54) DISPENSING AND ULTRAVIOLET (UV) CURING WITH LOW BACKSCATTER

(71) Applicant: Excelitas Canada, Inc., Vaudreuil-Dorion (CA)

(72) Inventors: Yong Wang, Markham (CA); Erik Sorensen, Mississauga (CA); Paul Constantinou, Burlington (CA)

(73) Assignee: Excelitas Canada, Inc., Vaudreuil-Dorion (CA)

( * ) Notice: Subject to any disclaimer, the term of this patent is extended or adjusted under 35 U.S.C. 154(b) by 236 days.

(21) Appl. No.: 14/657,259

(22) Filed: Mar. 13, 2015

(65) Prior Publication Data

US 2016/0263619 A1 Sep. 15, 2016

(51) Int. Cl.

| | |
|---|---|
| ***B05D 3/06*** | (2006.01) |
| ***B05C 9/12*** | (2006.01) |
| ***B05C 9/14*** | (2006.01) |
| ***F21V 29/75*** | (2015.01) |

(52) U.S. Cl.

CPC ..... *B05D 3/067* (2013.01); *B05C 9/12* (2013.01); *B05C 9/14* (2013.01); *B05D 3/061* (2013.01); *F21V 29/75* (2015.01)

(58) Field of Classification Search

CPC .... B05C 9/12; B05C 9/14; B05D 3/06; B05D 3/061; B05D 3/067; F21V 29/75

See application file for complete search history.

(56) References Cited

U.S. PATENT DOCUMENTS

| | | | | |
|---|---|---|---|---|
| 5,515,254 | A * | 5/1996 | Smith | F21V 5/04 362/293 |
| 5,667,850 | A * | 9/1997 | Gaven | B05D 3/067 118/45 |
| 6,217,695 | B1 * | 4/2001 | Goldberg | B05D 3/06 156/244.17 |
| 6,482,264 | B1 * | 11/2002 | Sun | B01J 19/0046 118/300 |
| 6,603,132 | B1 * | 8/2003 | Van Der Blij | B05D 3/067 156/272.2 |
| 8,523,387 | B2 | 9/2013 | Anderson et al. | |
| 2003/0026919 | A1 * | 2/2003 | Kojima | C03C 25/12 427/558 |
| 2010/0091493 | A1 | 4/2010 | Marson | |
| 2012/0287214 | A1 | 11/2012 | Fujisawa | |

* cited by examiner

*Primary Examiner* — Dah-Wei D. Yuan
*Assistant Examiner* — Stephen A Kitt
(74) *Attorney, Agent, or Firm* — Peter A. Nieves; Sheehan Phinney Bass & Green PA

(57) ABSTRACT

A dispensing and ultraviolet (UV) curing system is disclosed with low backscatter. The system includes a dispenser for dispensing an ultraviolet (UV) curable material onto a substrate and a UV radiation source assembly coupled to the dispenser and operable to facilitate curing the UV curable material that has been dispensed onto the substrate. The UV radiation source assembly has a UV radiation source with a first optical axis and an optical element with a second optical axis. The second optical axis is different than the first optical axis. The optical element is configured such that, during operation, UV radiation from the UV radiation source passes through the optical element.

31 Claims, 10 Drawing Sheets

DISPENSING AND ULTRAVIOLET (UV) CURING WITH LOW BACKSCATTER

FIELD OF THE INVENTION

The present disclosure relates to dispensing and ultraviolet (UV) curing and, more particularly, relates to dispensing UV curable material and UV curing the material with low backscatter.

BACKGROUND

Ultraviolet (UV) radiation can be used to cure UV curable materials, such as inks, adhesives, coatings, etc. Many industries take advantage of UV curing technologies, including medical, automotive, cosmetic, food, scientific, educational and art.

SUMMARY OF THE INVENTION

In one aspect, a dispensing and ultraviolet (UV) curing system is disclosed with low backscatter. The system includes a dispenser for dispensing an ultraviolet (UV) curable material onto a substrate and a UV radiation source assembly coupled to the dispenser and operable to facilitate curing the UV curable material that has been dispensed onto the substrate. The UV radiation source assembly has a UV radiation source with a first optical axis and an optical element with a second optical axis. The second optical axis is different than the first optical axis. The optical element is configured such that, during operation, UV radiation from the UV radiation source passes through the optical element.

In another aspect, a dispensing and ultraviolet (UV) curing system with low backscatter is disclosed. The system includes a dispenser for dispensing an ultraviolet (UV) curable material onto a substrate and a UV radiation source assembly coupled to the dispenser and operable to facilitate curing the UV curable material that has been dispensed onto the substrate. The dispenser and the UV radiation source assembly are configured to move together relative to the substrate.

The UV radiation source assembly includes a UV radiation source for producing UV radiation. The UV radiation source has a first optical axis. The UV radiation source assembly includes an optical element having a second optical axis. The second optical axis is different than the first optical axis. The optical element is configured relative to the UV radiation source such that the UV radiation passes through the optical element before exiting the UV radiation source assembly.

A reflector is configured to guide the UV radiation produced by the UV radiation source to the optical element.

A mounting board has a surface that is disposed at an angle other than parallel relative to a surface of the substrate where the dispenser dispenses the UV curable material. The UV radiation source is mounted on the angled surface of the mounting board and the angled surface is angled away from the dispenser.

A heat sink, with a plurality of fins, is thermally coupled to the UV radiation source.

The UV radiation exits the UV radiation source assembly in a direction relative to the substrate such that a substantial portion of backscatter radiation off the substrate is directed away from the UV curable material traveling between the dispenser and the substrate.

In some implementations, one or more of the following advantages are present.

For example, a system is provided that can effectively and reliably, over a long course of time, deposit UV curable material (e.g., inks and the like) onto a substrate and cure the dispensed UV curable material. In a typical implementation, the systems and methods disclosed herein reduce or eliminate the likelihood that any backscatter radiation reflecting off the substrate might undesirably cure the UV curable material being delivered by the dispenser before it reaches the substrate (e.g., at the dispenser nozzle).

A typical implementation, for example, provides for depositing UV curable material on a substrate and UV curing with a compact, low cost, easy to maintain, system that collimates and/or focuses UV radiation for curing purposes, allowing for little, if any, back scatter radiation to the dispenser. Typically, this is accomplished without compromising the UV irradiance provided at the substrate Additionally, the optical element (e.g., lens), through which the UV curing radiation is delivered, has a substantially flat outer surface, which is very easy to clean, thereby improving system performance and also, perhaps, extending the operational life of the UV curing assembly.

Moreover, a typical implementation of the system utilizes UV light emitting diode (LED) technology, which allows for excellent beam shaping, collimation and/or beam steering. In recent years, solid state light emitting devices (LEDs) such as light emitting diodes have been developed as a type of energy efficient source for industrial processes, such as photo-reactive or photo-initiated processes, including photo-curing of inks for printing application. Many traditional arc lamps, which may also be used for UV light sources for industrial processes contain mercury. Thus, solid-state light sources may be preferred for environmental reasons, as well as longer lifetime. In general, UV LEDs generate much less heat and consume much less power than arc lamps, for the same (or similar) light output levels. Many inks, adhesives and other curable coatings comprise free radical based or cationic formulations which may be photo-cured by exposure to UV light. LED technology in connection with the other concepts described herein enables some common problems in print to be solved.

For example, some implementations realize reduced back scatter radiation to the dispenser (e.g., the printing head). In general, for inkjet printing applications, there is a minimum irradiance and dose requirement to fully cure or 'pin' the ink. However, there is a risk that scattered light from a powerful UV head might reflect back onto the ink jetting nozzles at the dispenser, causing the UV curable material (e.g., ink) to cure before it is jetted (i.e., fully released from the nozzle). If too much UV light is reflected onto the dispenser, the system may eventually be comprised and/or more maintenance may be required. Generally speaking, the ink jetted onto the substrate needs to be cured or pinned as soon as possible (to prevent dot spread), so the UV head, in a typical implementation, is as close as possible to the dispenser. In a typical implementation, the techniques and systems disclosed herein can reduce the amount of UV radiation reflected back onto the dispenser without increasing the spacing between UV radiation source assembly and dispenser. In some instances, the spacing increase might increase the delay between UV irradiation and dispensing. For some application, this delay is not undesirable, impermissible, and/or may cause the curing material to spread, for example, in ink pinning applications.

In some implementations, the systems disclosed herein produce excellent irradiance profiles.

In some implementations, the systems and techniques disclosed herein maintain a desirable optical beam profile on the substrate with excellent peak irradiance.

In a typical implementation, the UV radiation source assembly and, in particular, the optical element (e.g., lens) is easily cleaned and is replaceable and/or disposable.

For inkjet printing applications, the LED head window contamination is generally not avoidable because UV head is so close to printing head. An easy to clean and replaceable window is highly desirable for UV curing systems in print applications.

In a typical implementation, the UV radiation source assembly includes a low cost integrated window and beam shaping lens.

For some inkjet printing applications, there is an irradiance and dose requirement on the print media. In general, certain optics may be needed to achieve higher irradiance at certain working distances. In some instances, adding an extra window in front of the optical system may cause additional losses to be incurred from the reflection from the two surfaces. It also may add extra distance in the optical path and since the light may not be fully collimated this also may affect the energy density and/or irradiance at the print media or substrate. A molded lens is generally a good option for focusing the beam and using the flat surface of the lens for the window decreases overall losses in the system. In general, this may be referred to as an integrated lens window. In some instances, the molded lens window is easily replaceable and disposable. An entirely molded lens may be ideal for low cost but it may difficult to meet all the requirements: low cost, high UV transmission, high heat tolerance, and cleanable flat surface. It would be difficult to aggressively clean the surface of such lens and as ink build up more and more light is absorbed causing the optic to heat up beyond its specification. A glass/molded silicon combination, as described herein, is a good solution because of its multi-purpose function, low cost and ability to meet all the application requirements. At same time, the lens window can be customized and designed so that a required beam profile and high irradiance can be achieved. In addition, for some applications silicon may react with the UV curable material and degrade. In this case the low cost portion of the optical element is used to protect the silicon.

Moreover, in some implementations, the dual optical axis design (i.e., the UV radiation source having a first optical axis and the optical element having a different optical axis) allows the UV radiation to exit the system at a larger angle at a close distance to the UV curable material with a compact form factor.

Other features and advantages will be apparent from the description and drawings, and from the claims.

BRIEF DESCRIPTION OF THE DRAWINGS

Like reference characters refer to like elements.

DETAILED DESCRIPTION

Figure 1A:
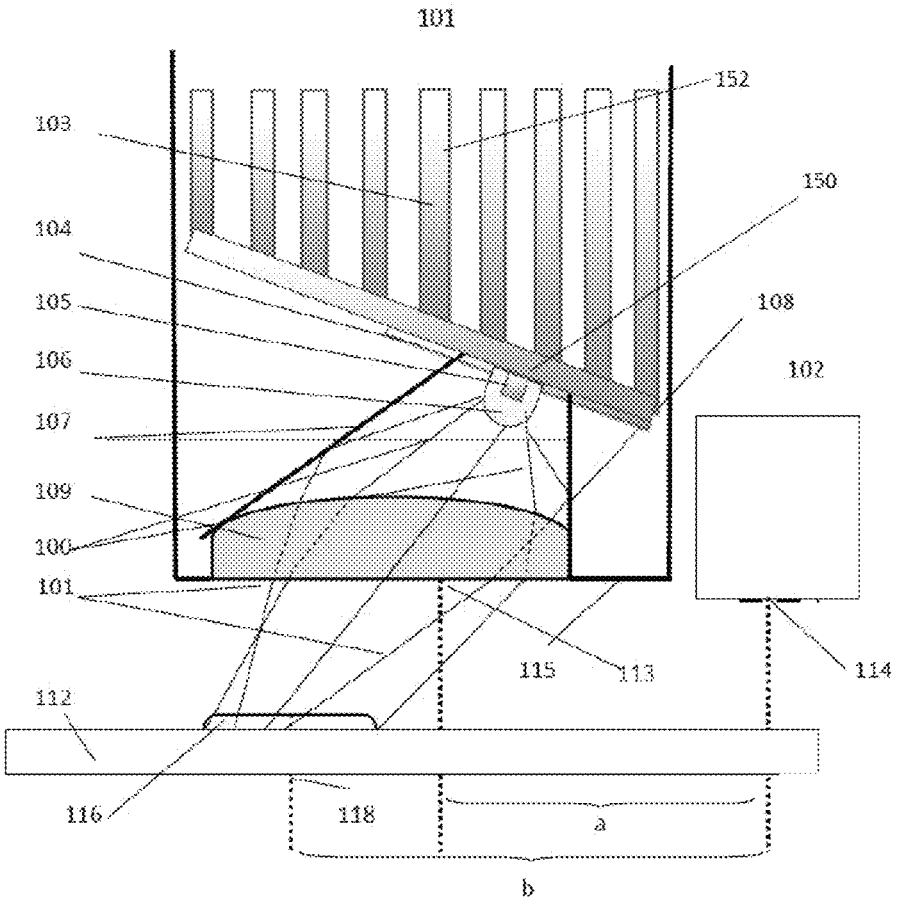
FIG. 1A is a schematic cross-sectional view of an exemplary implementation of a dispensing and ultraviolet (UV) curing system.

FIG. 1A shows an exemplary implementation of a dispensing (e.g., printing) and ultraviolet (UV) curing system 101. The illustrated system 101 has a dispenser 102 for dispensing a ultraviolet (UV) curable material (e.g., ink) onto a substrate 112, and a UV radiation source assembly 108 coupled to the dispenser 102 and operable to facilitate curing the UV curable material that has been dispensed onto the substrate 112. In a typical implementation, the substrate 112 is reflective (e.g., having some degree of reflectivity) so that a significant amount of the incident UV radiation reflects off of the substrate. The illustrated system 101 is configured to minimize any negative impact that this backscatter radiation (e.g., radiation reflecting off the substrate 112) might produce by partially or completely curing the UV curable material being dropped from the dispenser 102 onto the substrate (i.e., before the UV curable material reaches the substrate 112).

In this regard, the system 101 is operable to transmit UV radiation at an angle relative to the substrate 112 such that at least a substantial portion of any backscatter radiation reflected off the substrate 112 will be directed away from the UV curable material being dropped from the dispenser 102 onto the substrate 112. In some implementations, all of the backscatter radiation reflected off the substrate 112 will be directed away from the UV curable material. However, in other implementations, some lesser, but still substantial, amount of the backscatter radiation reflected off the substrate will be directed away from the UV curable material being dropped from the dispenser 102 onto the substrate 112. The specific percentage of backscatter radiation directed away from the UV curable material being dropped from the dispenser 102 onto the substrate 112 will vary from implementation to implementation, but, generally speaking, the amount should be enough to minimize or eliminate risk or problems associated with inadvertently curing the UV curable material being dropped by the dispenser 102 onto the substrate 112. In some examples, the amount may be 80%, 85%, 90%, 95% or more.

The illustrated system 101 provides these features and functionalities in a highly efficient manner and with a highly compact structure. The highly compact structure is facilitated in part by a heat sink design in the UV radiation source assembly 108 that provides for the highly efficient management of heat, particularly the heat generated by the UV radiation source 105, in the context of the overall assembly 108 design.

The illustrated UV radiation source assembly 108 has a housing 115 an UV radiation source 105 for producing UV radiation inside the housing 115. The UV radiation source 105 can be virtually any device capable of producing UV radiation including, for example, a mercury vapor bulb, a mercury vapor bulb with an iron additive, a mercury vapor bulb with gallium additive, or a fluorescent bulb. In some implementations, the UV radiation source 105 is based on light emitting diode (LED) technology and may be, in fact, an LED array with an encapsulation lens, as shown in FIG. 1A.

The UV radiation source 105 is mounted (and, e.g., bonded) to a surface of a mounting board 104, which, in the illustrated example, is a printed circuit board (PCB). In the illustrated example, both the mounting board 104 and the surface of the mounting board 104 where the UV radiation source 105 is mounted are disposed at an angle other than parallel to the substrate surface, upon which the UV curable material gets dispensed. More particularly, in the illustrated example, the angled surface of the mounting board 104 is angled away from the dispenser 102. The angle Θ, in the illustrated example, is approximately 20 degrees. However, the angle Θ can have other values as well. For example, in some implementations, the angle Θ can be anywhere from about 5 degrees to about 50 degrees (e.g., 10 degrees to 40 degrees, 15 degrees to 40 degrees, etc.). The specific angle Θ for a particular application may depend on a variety of factors including, for example, the distance between the nozzles 114 on the dispenser 102 and the radiation source assembly 108, the type of UV radiation being produced, the type of UV curable material being used, the reflectivity of the substrate 112 and UV curable material, as well as other factors. The mounting board 104 is also inside the housing 115.

An optical element 109 is configured relative to the UV radiation source 105 such that the UV radiation produced by the UV radiation source 105 passes through the optical element 109 to exit the UV radiation source assembly 108. The optical element 109 can be virtually any kind of optical element that facilitates transmittal of the UV radiation out of the assembly 108. In some implementations, for example, the optical element 109 is an optical lens.

In the illustrated implementation, a portion of the optical element 109 is exposed through an opening in the housing 115. More particularly, in the illustrated implementation, the flat bottom surface of the optical element 109 is exposed through the opening in the housing 109. During operation, the UV radiation produced by the UV radiation source 105 exits the assembly from the exposed bottom surface of the optical element 109.

In the illustrated implementation, an entirety of the exposed bottom surface of the optical element 109 is substantially flat. Moreover, in the illustrated implementation, the entirety of the exposed bottom surface of the optical element 109 is substantially parallel to the upper surface of the substrate 112 where the UV curable material gets dispensed. Also, in the illustrated example, the substantially flat exposed portion of the optical element 109 is substantially flush with the outer, bottom surface of the housing 115. In general, the flatness and flushness of the exposed portion of the optical element (i.e., the bottom surface of the optical element in FIG. 1A) is desirable because it makes cleaning that portion of the optical element easy.

The upper surface of the illustrated optical element 109 is convex and the side wall(s) of the optical element are straight and are approximately perpendicular to the flat bottom surface.

In the illustrated implementation, the UV radiation source has a first optical axis, and the optical element has a second optical axis that is different than the first optical axis. More particularly, in the illustrated implementation, the first optical axis is substantially perpendicular to the substrate upon which the UV curable material gets dispensed, and the second optical axis is disposed at an angle relative to the first optical axis such that at least a substantial portion of any backscatter radiation reflected off the substrate will be directed away from the UV curable material being dropped by the dispenser onto the substrate. The angle can between about 5 degrees and 50 degrees.

In the illustrated implementation, the second optical axis of the optical element 109 extends through the centerline of the optical element in a vertical direction. As shown, the UV radiation source 105 is off-center relative to (i.e., not physically located on) the optical axis. More particularly, in the illustrated implementation, the UV radiation source 105 is on the dispenser 102 side of the optical axis. The distance of that offset can vary depending on a variety of factors including, for example, the angle Θ of the mounting board 104, the relative position and size of the optical element, the distance between the UV radiation source 105 and the optical element 109, etc. However, generally speaking, offsetting the position of the UV radiation source toward the dispenser relative to the optical axis, particularly on the angled mounting surface, can help angle the radiation that gets emitted from the assembly 108 away from the dispenser 102. The UV radiation source 105 is offset from the second optical axis A2 between about 10% and 60% of the distance between the optical axis and an edge of the mounting board nearest the dispenser.

In a typical implementation, the optical element 109 is a relatively low cost product that can, therefore, be easily replaced if it becomes damaged or somehow compromised. The optical element 109 should be suited to withstand operating temperatures appropriate to its use, which, being so near to the UV radiation source, can be quite high. Moreover, the optical element 109 is configured to focus the UV radiation onto a particular spot or area (e.g., 116 in FIG. 1A) on the substrate 112.

In some implementations, the optical element 109 is formed having multiple different layers including, for example, a front layer and a back layer. In one implementation, the front layer can be a material having high UV transmissivity and high temperature tolerance (e.g., low cost quartz and BK7). Very often, the UV curable material (e.g., ink) can contaminate the front surface of the optical element 109. After contamination, if left unattended to, the UV curable material on the optical element 109 will absorb UV radiation and become very hot. A glass or quartz front surface generally can tolerate this high temperature. In one implementation, the back layer can be molded from UV resistant silicon that helps minimize cost of the lens 109 and allows for curved and other more complex lens structures. The single optics (e.g., the optical element 109) becomes a compound system constructed of these (or other) materials/layers service different functions.

There is a reflector 107 inside the housing 115. The illustrated reflector 107 is configured to guide the UV radiation produced by the UV radiation source 105 to the optical element 109. The reflector 107 can be any of a wide variety of materials. The inner surface of the reflector 107 is able to reflect the UV radiation produced by the UV radiation source 105. The reflector 107 and/or its reflective inner surface can be virtually any kind of material that is able to reflect the UV radiation produced by the UV radiation source 105.

In the illustrated implementation, the reflector 107 is essentially in the shape of an asymmetrical, truncated cone, open at both ends (i.e., the top and bottom). The narrower portion of the asymmetrical, truncated cone forms the top of the reflector 107 near the UV radiation source 105 and the wider portion of the asymmetrical, truncated cone extends downward towards the bottom of the reflector 107. In the illustrated example, the top of the reflector 107 is very close to, and butts up against, the mounting board 104 for the UV radiation source 105. The bottom of the reflector 107 is very close to, and touches, the optical element 109. In this regard, the reflector 107 defines and substantially surrounds a UV radiation path from the UV radiation source 105 to the optical element 109. When the UV radiation source 105 is illuminated, the resulting UV radiation travels down that path from the UV radiation source 105 to the optical element 109, with the reflective inner surface of the reflector internally reflecting and guiding the UV radiation toward the optical element 109.

The mounting board 104 for the UV radiation source 105 is physically mounted to a heat sink 103. The heat sink 103 is a passive heat exchanger that helps cool the UV radiation source assembly in general, and the UV radiation source 105 in particular, by dissipating heat into the surrounding medium. The illustrated heat sink 103 has a base portion 150 with an upper surface and a lower surface, and a plurality of fins 152 that extend in an upward direction from the upper surface of the base portion 150. Part of the lower surface of the base portion 150 is in direct physical contact with and extends along the mounting board 104.

The heat sink 103 is arranged within the housing 115 so that its base portion 150 is not parallel to the substrate 112 where the UV curable material gets dispensed. Like the mounting board 104 for the UV radiation source 105, the base portion 150 of the heat sink 103 is angled away from the dispenser 102. The angle Θ, in the illustrated example, is approximately 20 degrees. However, the angle Θ can have other values as well. For example, in some implementations, the angle Θ can be anywhere from about 5 degrees to about 50 degrees (e.g., 10 degrees to 40 degrees, 15 degrees to 40 degrees, etc.).

There are nine fins 152 in the illustrated implementation and each fin has a different length. Of course, the number of fins 152 and specific length of each fin can vary in different implementations. Moreover, the length of the fins changes from a first end (i.e., the left end) of the illustrated heat sink to a second end (i.e., the right end) of the illustrated heat sink, becoming progressively longer. The distal ends of all the fins lie in approximately the same plane, which, in the illustrated example, is substantially parallel to the surface of the substrate 112 where the UV curable material gets dispensed.

In the illustrated example, the heat sink 105 is inside the housing 115 but the upper portion of the heat sink 105, including the fins 152, is exposed through an opening in the top of the housing 115. In some implementations, this type of arrangement can further facilitate effectively dispersing heat. In general, the illustrated heat sink configuration contributes to the UV radiation source assembly's ability to provide a high degree of UV curing with an overall compact package design.

In FIG. 1A there are lines representing UV radiation that extend from the UV radiation source 105, through the optical element 109 and down to the substrate 112. Some of the UV radiation represented by these lines is reflected off the inner surface of the reflector 107 before passing through the optical element. In the illustrated example, the UV radiation illuminates an area 116 on the upper surface of the substrate and is able to cure any UV curable material in the illuminated area 116. In the illustrated example, the illuminated area 106 is off-center relative to the optical axis of the optical element 109. More particularly, a substantial portion of the illuminated area lies to the left of the optical axis of the optical element 109, that is, on a side of the optical axis opposite the side where the dispenser 102 is located.

Moreover, a substantial portion of the UV radiation landing on the illuminated area 116 in FIG. 1A arrives at an angle such that a substantial portion of backscatter radiation off the substrate 112 will be directed away from the UV curable material that is being dispensed by the dispenser 102 onto the substrate 112. In some implementations, all (or substantially all) of the UV radiation landing on the illuminated area 116 does so from angle of between approximately 10 degrees and 80 degrees relative to the upper surface of the substrate 112. In some implementation, the range of angles will be between approximately 15 degrees and 70 degrees. In some implementations, the angle is anything greater than about 30 degrees.

In a typical implementation, the substrate 112, upon which UV curable material is dispensed and then cured, sits upon a support element (e.g., a conveyer belt or simply a support surface) while the UV curable material is being dispensed and while the dispensed material is being cured. The UV radiation source assembly 108 and the dispenser 102 are configured to move together, relative to the substrate (or surface upon which the substrate sits). Typically, during operation, the dispenser 102 dispenses UV curable material onto the substrate 112 and then either the UV radiation source assembly/dispenser or the substrate moves so that the UV curable material that has been dispensed onto the substrate is moved to the illuminated area 116 to be cured.

In the illustrated example, the UV radiation source assembly 108 and the dispenser 102 are shown as separate physical structures. As mentioned above, somehow, these separated physical structures are maintained at fixed positions (e.g., side-by-side, as shown) relative to each other during system operation. There are a variety of ways that this can be achieved. For example, in some implementations, the UV radiation source assembly 108 and the dispenser 102 are physically secured to one another—either directly or indirectly. In other implementations, the UV radiation source assembly 108 and the dispenser 102 might share a common housing. In a typical implementation, the UV radiation source assembly is next to or close to the dispenser.

In the illustrated implementation, the distance (b) between where the emitted UV radiation hits the substrate (i.e., the illuminated area 116) is larger than the distance (a) between the midpoint of the dispenser 102 and the midpoint of the UV radiation source assembly 108.

The dispenser 102 has one or more print nozzles 114 at a bottom surface thereof. The print nozzle(s) 114 is (are) configured to expel the UV curable material out of the dispenser 102.

In a typical implementation, the configuration of the reflector 107 and the location of the lens 109 are optimized to achieve a desired beam pattern at the substrate 112 and to maximize, for example, peak irradiance and dose. Moreover, the lens shape typically is optimized to produce a desirable beam profile on the substrate as well as maximizing irradiance. The lens design (and other aspects of the system) can be customized for various applications.

Figure 1B:
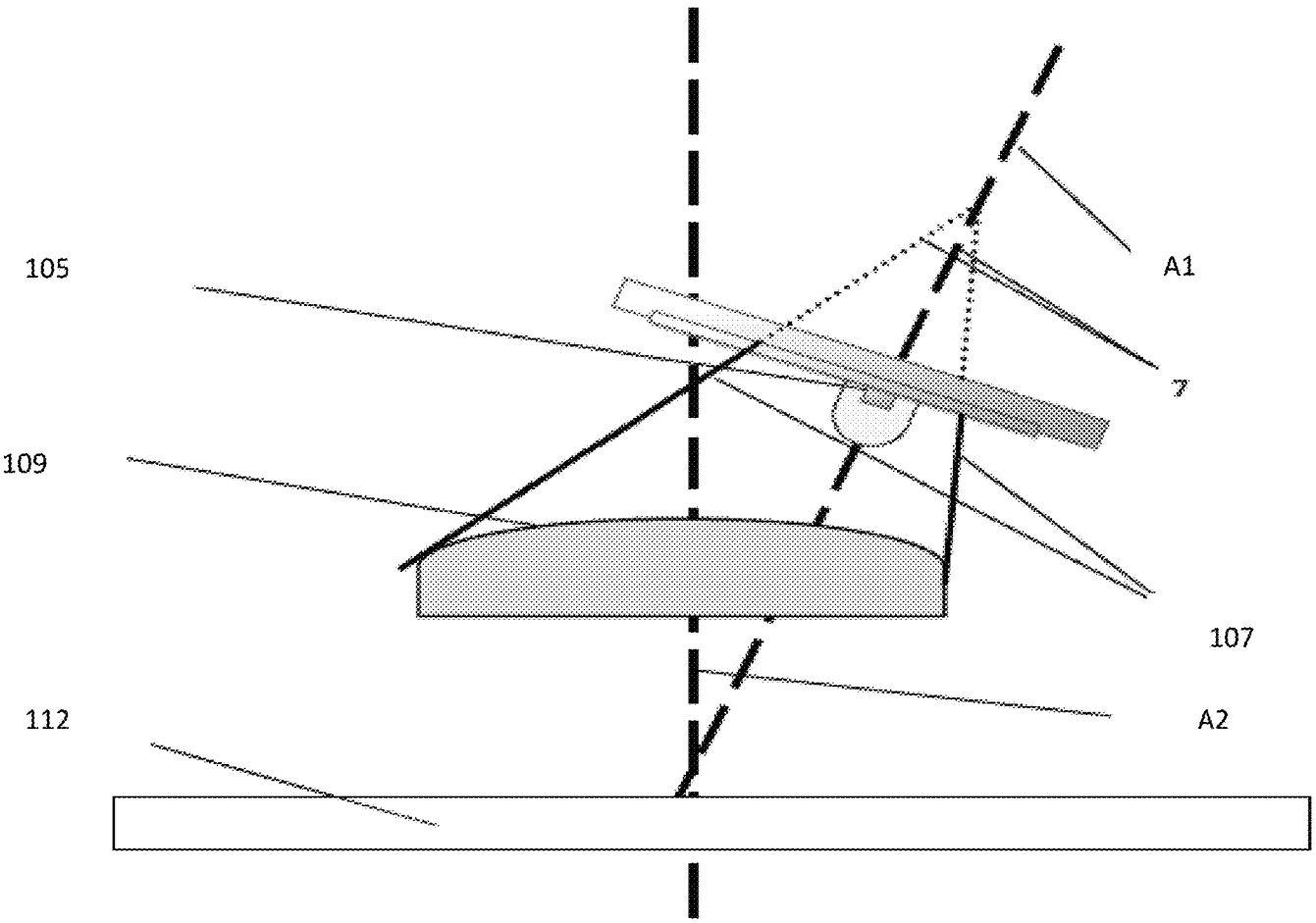
FIG. 1B is a schematic cross-sectional view showing dual optical axes in the exemplary implementation of the dispensing and ultraviolet (UV) curing system in FIG. 1A.

FIG. 1B shows the first optical axis A1 of the UV radiation source 105 and the second optical axis A2 of the optical element 109. The second optical axis A2 clearly is different than the first optical axis A1. More particularly, the second optical axis A2 is substantially perpendicular to the substrate 112 upon which the UV curable material gets dispensed, and the first optical axis A1 is disposed at an angle relative to the second optical axis A2 such that at least a substantial portion of any backscatter radiation reflected off the substrate will be directed away from the UV curable material being dropped by the dispenser 102 onto the substrate 112. In some implementations, the angle can be between about 5 degrees and 50 degrees.

Figure 2:
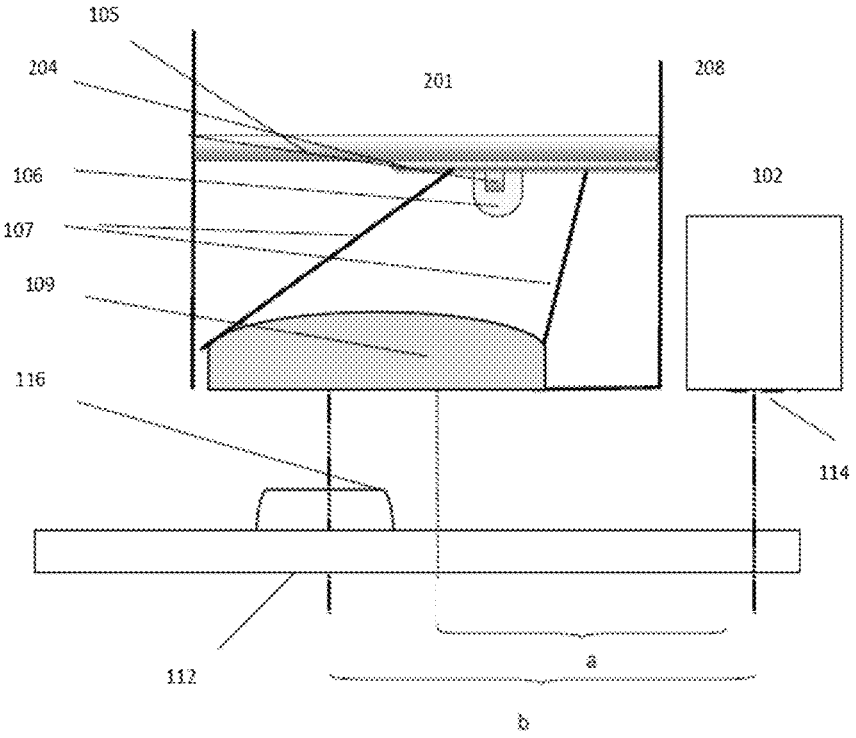
FIG. 2 is a schematic cross-sectional view of an alternative exemplary implementation of a dispensing and ultraviolet (UV) curing system.

FIG. 2 shows an alternative implementation of a dispensing and ultraviolet (UV) curing system 201 that is somewhat similar to the implementation shown in FIG. 1A.

The system 201 in FIG. 2 differs from the system in FIG. 1A mainly in that the mounting board 204 in FIG. 2 is not disposed at an angle relative to horizontal. Indeed, the mounting board 204 in FIG. 2 is substantially parallel to the substrate 112, upon which the UV curable material to be cured gets dispensed. The base portion of the heat sink, upon which the mounting board is mounted, is also substantially parallel to the substrate 112. In a typical implementation, the fins of the heat sink (not shown in FIG. 2) would extend in an upward direction from the base portion of the heat sink away from the UV radiation source.

In FIG. 2 UV radiation from the UV radiation source 105 passes through the optical element 109 and down to the substrate 112. Some of the UV radiation is reflected off the inner surface of the reflector 107 before passing through the optical element 109. In the illustrated example, the UV radiation illuminates an area 116 on the upper surface of the substrate and is able to cure any UV curable material in the illuminated area 116. In the illustrated example, the illuminated area 106 is off-center relative to the optical axis of the optical element 109. More particularly, a substantial portion of the illuminated area 116 lies to the left of the optical axis of the optical element 109, that is, on a side of the optical axis opposite the side where the dispenser 102 is located.

In some implementations, generally speaking, the irradiance distribution of the illuminated area 116 should meet corresponding curing or pinning requirements.

With the illustrated arrangement, the UV radiation source assembly is able to deliver UV radiation to the substrate at an angle such that at least a substantial portion of any backscatter radiation reflected off the substrate will be directed away from the UV curable material being dropped by the dispenser onto the substrate. The arrangement in FIG. 2 represents another way to increase the distance and angle between UV irradiator and dispenser, but it generally has lower irradiance (see FIG. 7) and higher back reflection (see FIG. 8) issues.

Figure 3:
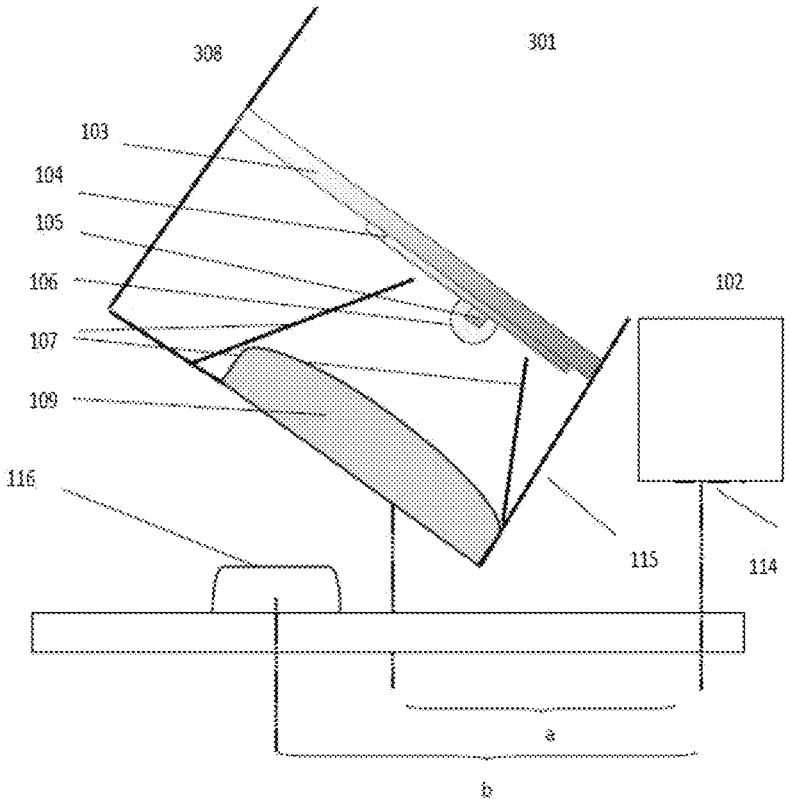
FIG. 3 is a schematic cross-sectional view of yet another alternative exemplary implementation of a dispensing and ultraviolet (UV) curing system.

FIG. 3 shows an alternative implementation of a dispensing and ultraviolet (UV) curing system 301 that is also somewhat similar to the implementation shown in FIG. 2.

The system 301 in FIG. 3 differs from the system 201 in FIG. 2 mainly in that the entire UV radiation source assembly 308 in the FIG. 3 is angled away from the adjacent dispenser 102. Also, the relative arrangement of the UV radiation source 105, optical element 109 and reflector 107 in the system 301 of FIG. 3 is different than the corresponding arrangement in FIG. 2.

Figure 7:
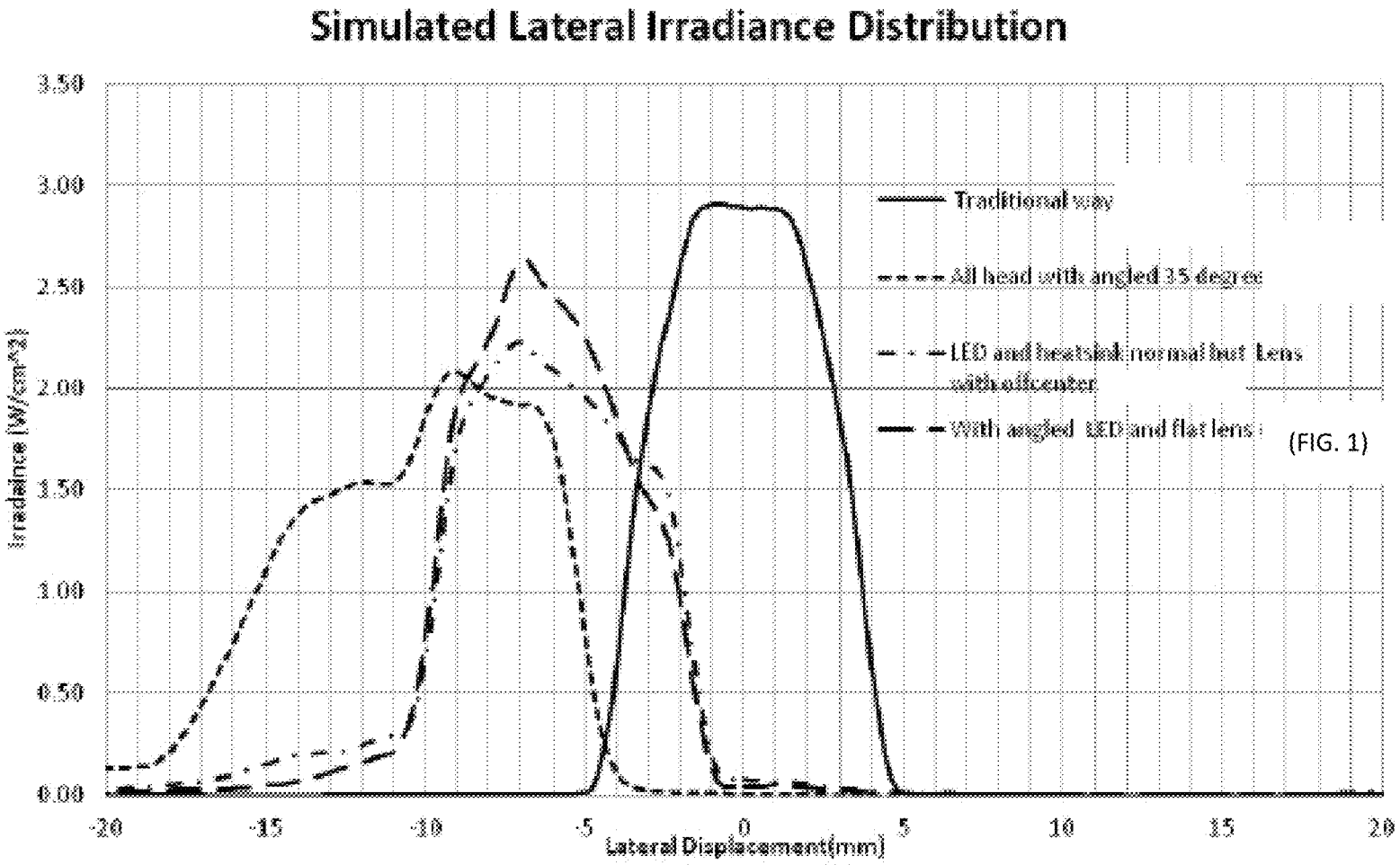
FIG. 7 is a plot of simulated lateral irradiance distribution for different types of UV radiation source assemblies.

The arrangement in FIG. 3 represents one way to increase the distance and angle between UV irradiator and dispenser. FIG. 7 shows the shape of the beam becomes wide. Moreover, peak irradiance is generally lower at the same working distance because the angle of the front surface of the head dramatically increase the distance between UV irradiator and dispenser. Also, this configuration increases the space between the UV irradiator and the dispenser. For some applications, the resulting delay between UV irradiation and dispensing is undesirable, not permissible, and/or causes the curing material to spread, for example, in pining applications.

Figure 4:
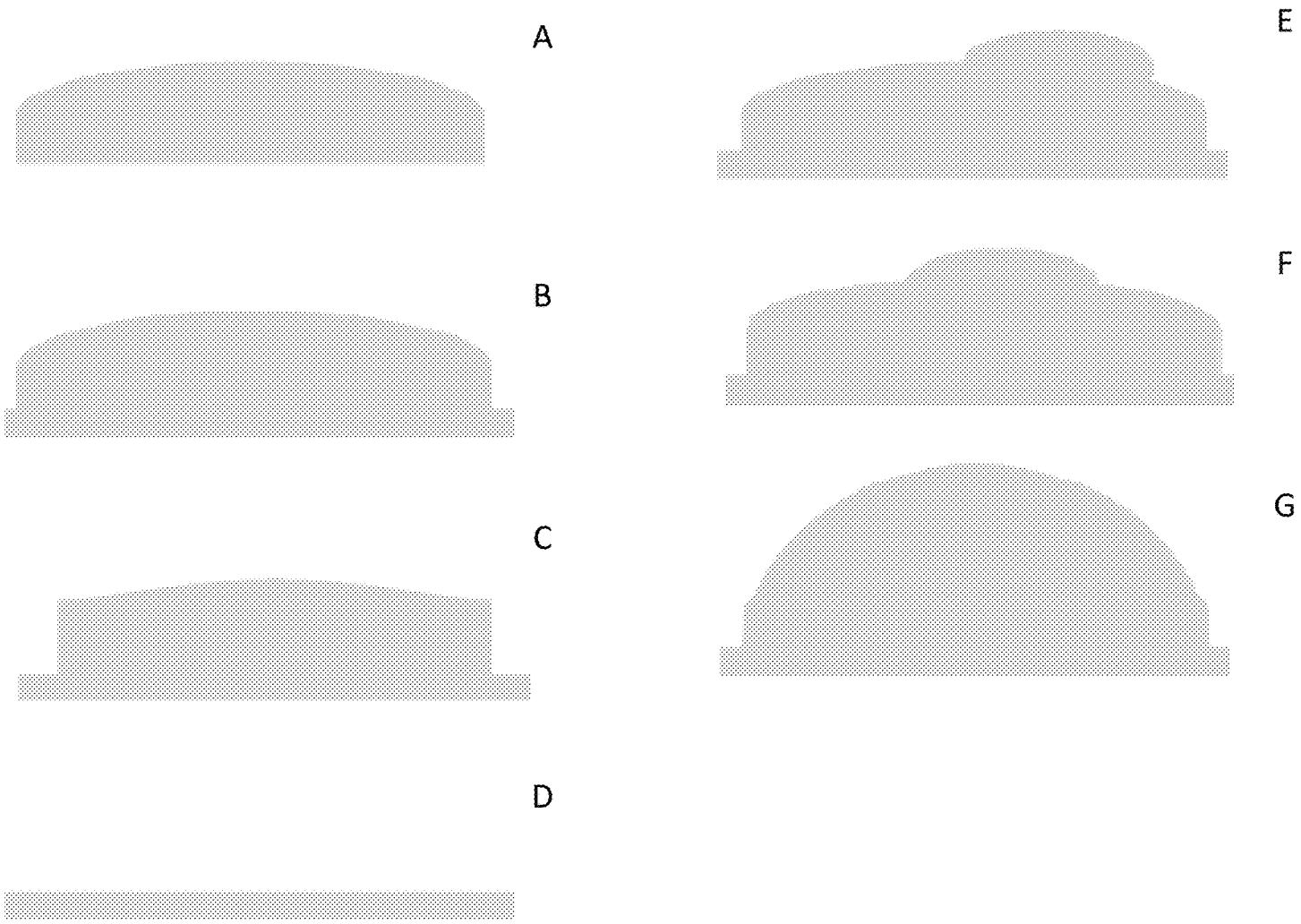
FIG. 4 includes schematic side view representations of different shapes for the optical element.

Referring now to FIG. 4, the optical element 109 can have a variety of shapes. In most instances, the front surface (i.e., the surface facing the substrate 112) is substantially flat. However, in various implementations, the back surface of the optical element 109 can have different shapes. Generally speaking, if the optical element 109 has a molded back layer, the molded back layer is a good option for low cost and complex aspherical lens profiles. The material is generally low cost, easy to mold, with high UV transmissivity and good durability, particularly at higher temperatures.

FIG. 4 shows various examples of shapes that the optical element 109 can have.

Example A corresponds to the shape in FIG. 1A, for example. Example B includes a flat front layer that can be made of glass and a back layer with a curved back surface that can be made of UV resistant silicon. Example C includes a flat front layer that can be made of glass and a back layer that forms two flat surfaces that meet at a peak and that can be made of UV resistant silicon. Example D is just a flat glass window. Example E includes a flat front layer that can be made of glass and a back layer with a curved back surface that can be made of UV resistant silicon. The curved back layer includes an off-center bump. Example F is similar to example E except the bump is substantially centered. Example F includes a flat front layer that can be made of glass and a back layer with a substantially aspherical back surface that can be made of UV resistant silicon.

Figure 5:
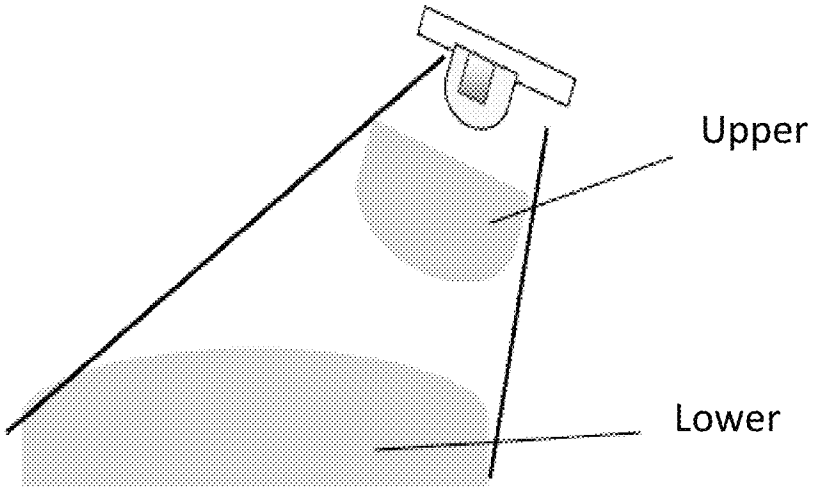
FIG. 5 is a schematic cross-sectional view of part of yet another exemplary implementation of a dispensing and ultraviolet (UV) curing system.

FIG. 5 shows a partial cross-sectional view of an implementation of a dispensing and ultraviolet (UV) curing system that has an extra optical element (e.g., lens) arranged in the UV radiation path between the UV radiation source and the optical element, through which the UV radiation exits the UV radiation source assembly. The UV radiation path is surrounded and defined by the illustrated reflector. Moreover, the extra optical element is snug against the inner surface of the reflector so that all of the UV radiation that travels from the UV radiation source to the lower optical element will pass through the extra optical element.

In FIG. 5, the optical axis of the upper optical element is substantially aligned with the optical axis of the UV radiation source and the optical axis of the lower optical element is not so aligned. Instead, it is disposed at an angle relative to the optical axis of the UV radiation source such that at least a substantial portion of any backscatter radiation reflected off the substrate will be directed away from the UV curable material being dropped by the dispenser onto the substrate.

Figure 6:
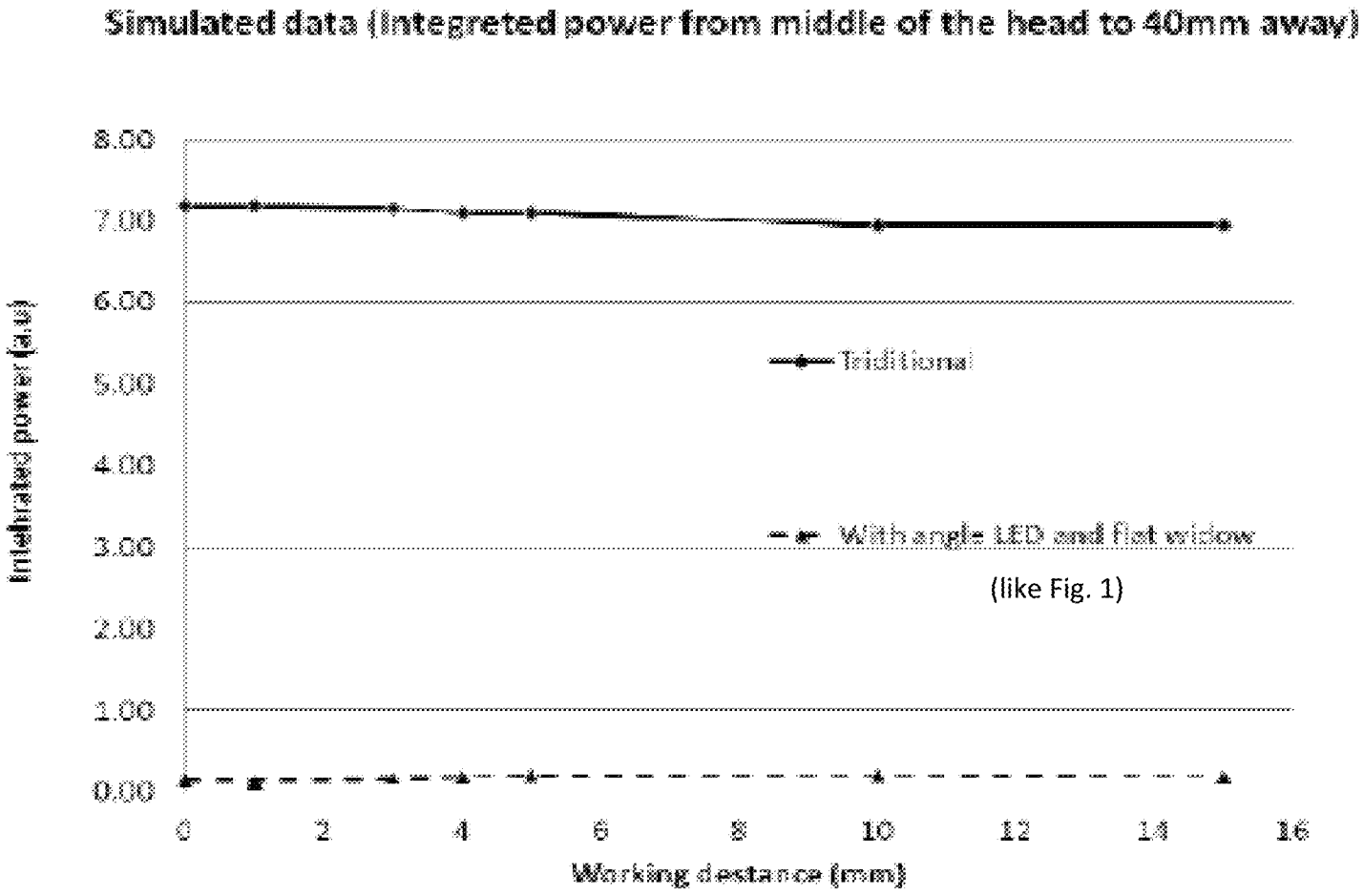
FIG. 6 is a plot of integrated power vs. working distance for different types of UV radiation source assemblies.

FIG. 6 is a chart with simulated data representing integrated power from the middle of the UV source head to 40 mm away in different types of systems. The different types of systems represented include a traditional UV radiation source and a system with a UV radiation source having an angled LED and a flat optical element, similar to what is shown in FIG. 1A. The illustrated chart shows that the integrated optical power from the center of the UV head to the dispenser with a traditional UV radiation source tends to be much higher than the integrated optical power from the center of the UV head to the dispenser in a system with a UV radiation source that has the angled LED and the flat optical element.

FIG. 7 is a chart with simulated data representing lateral irradiance distribution in different types of systems. The different types of systems represented include: a system with a traditional UV radiation source, a system with the whole UV head angled at 35 degrees (similar to FIG. 3), a system with a UV source that has an LED and heat sink normal to the substrate but the optical element offset (similar to FIG. 2), and a system with an angled LED and a flat optical element (similar to FIG. 1A). FIG. 7 shows that for the FIG. 3 type of configuration, the beam profile is much wider and the peak irradiance is lower than the other configurations at same working distance. This may be because the emitting plane is not perpendicular to the substrate and the distance between the UV system and the substrate is increased.

Figure 8:
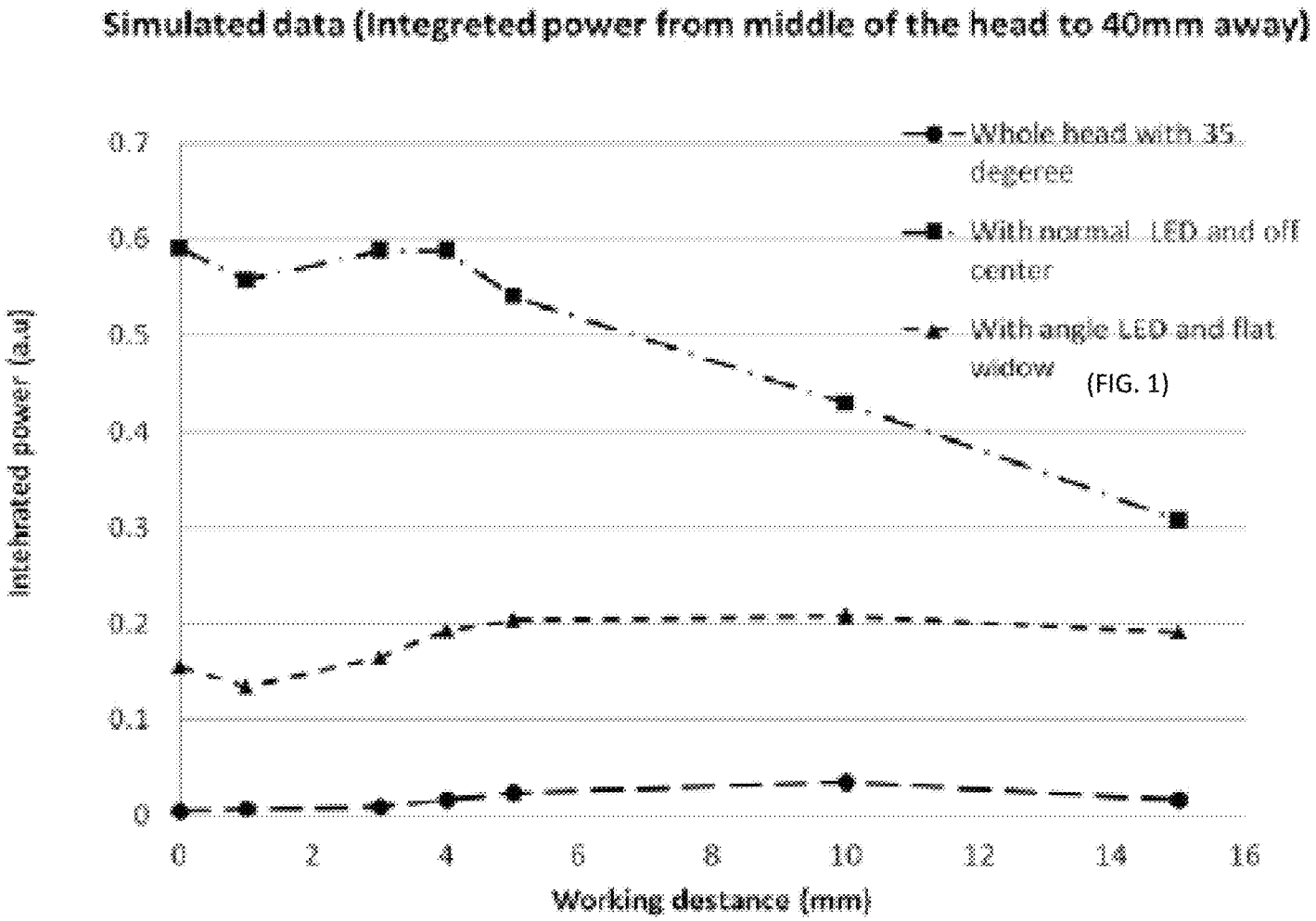
FIG. 8 is a plot of integrated power vs. working distance for different types of UV radiation source assemblies.

FIG. 8 is a chart with simulated data representing integrated power from the middle of the UV source head to 40 mm away in different types of systems. The different types of systems represented include: a system with a system with the whole UV head angled at 35 degrees (similar to FIG. 3), a system with a UV source that has an LED normal to the substrate but offset (similar to FIG. 2), and a system with an angled LED and a flat optical element (similar to FIG. 1A). FIG. 8 shows that the integrated optical power from center of the UV system to the dispenser with the traditional system is much higher than the integrated output power from the system that is similar to FIG. 1A.

Figure 9:
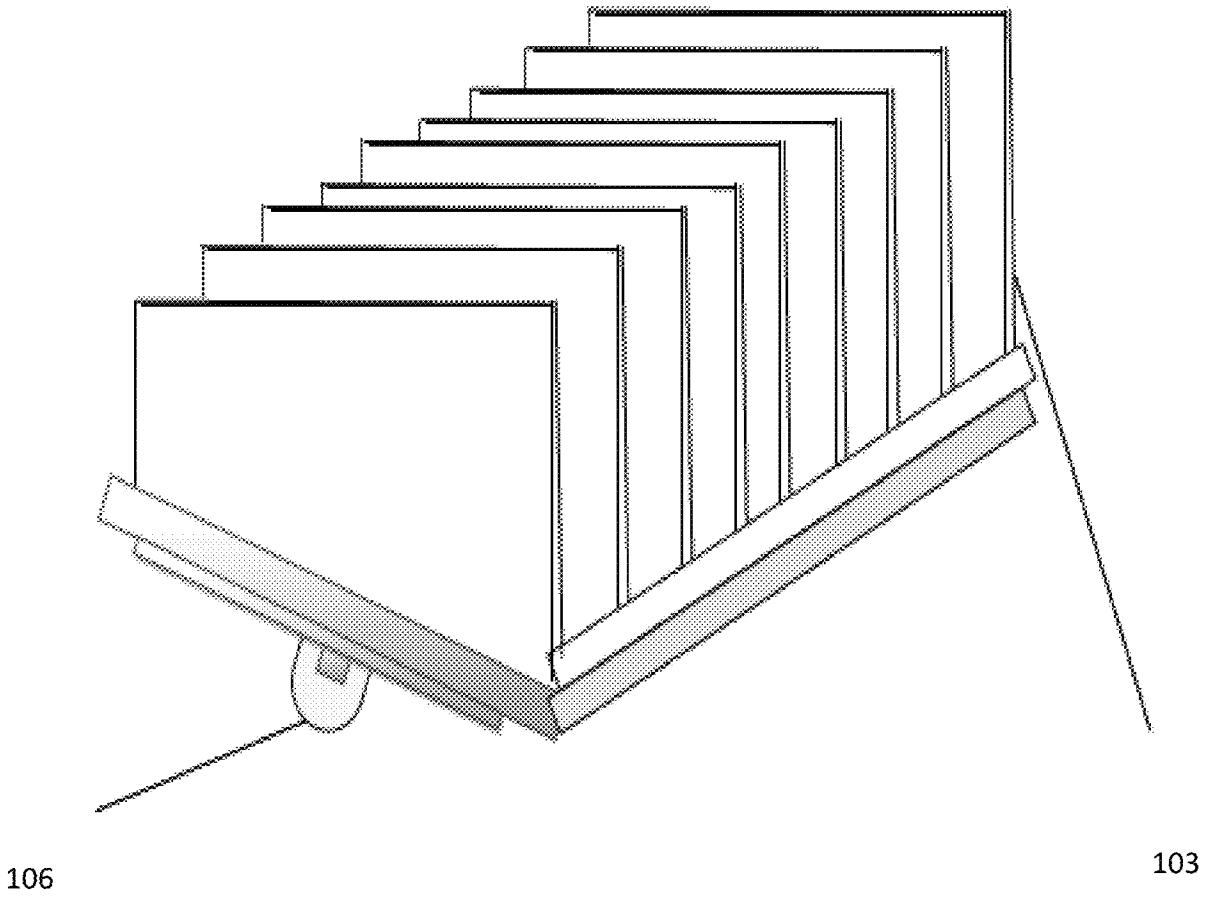
FIG. 9 is a partial perspective view showing an alternative heat sink design.

FIG. 9 is a partial perspective view showing an alternative heat sink design.

In the illustrated example, each fin of the heat sink 103 is trapezoidal, substantially equal in size and extends away from the mounting board in a direction that is substantially parallel to the second optical axis (A2). Moreover, each fin becomes progressively longer from a first end of the fin to a second end of the fin.

A number of embodiments of the invention have been described. Nevertheless, it will be understood that various modifications may be made without departing from the spirit and scope of the invention.

For example, the optical element has been described as being able to have several different shapes. However, other variations in optical element shape are possible as well.

The design, appearance, relative size and relative arrangement of the components in the overall system, including the dispenser and the UV radiation source assembly, can vary. Additionally, the design, appearance, relative size and relative arrangement of components in the UV radiation source assembly, including the printed circuit board, the UV radiation source, the reflector, the optical element, the heat sink, and the housing, can vary. Moreover, the design, appearance, relative size and relative arrangement of components of the dispenser can vary.

Some components of the overall system and/or the UV radiation source assembly and/or the dispenser described herein may be eliminated entirely. For example, in some implementations, the passive heat sink may be omitted and heat concerns may be addressed with either an active cooling system (with forced air or fluid) or by operating at lower temperatures.

Likewise, some implementations of the overall system and/or the UV radiation source assembly and/or the dispenser described herein may have additional components not specifically mentioned herein. Examples include components to control system operation, drive components to cause relative motion between the substrate, on the one hand and the UV head/dispenser on the other hand, etc.

The techniques, components and systems described herein can be applied to a wide range of industries, including, for example, medical, automotive, cosmetic, food, scientific, educational and art.

It should be understood that the relative terminology used herein, such as "upper", "lower", "above", "below", "front", "rear," etc. is solely for the purposes of clarity and is not intended to limit the scope of what is described here to embodiments having particular positions and/or orientations. Accordingly, such relative terminology should not be construed to limit the scope of the present application. Finally, the term substantially, and similar words such as substantial, is used herein. Unless otherwise indicated, substantially, and similar words, should be construed broadly to mean completely and almost completely (e.g., for a measurable quantity this might mean 99% or more, 95% or more, 90% or more, 85% or more). For non-measurable quantities (e.g., a surface that is substantially parallel to another surface), substantial should be understood to mean completely or almost completely (e.g., deviating from parallel no more than a few (e.g., less than 3, 4 or 5) degrees.

Other implementations are within the scope of the claims.

What is claimed is:

1. A dispensing and ultraviolet (UV) curing system with low backscatter, the system comprising:

a dispenser for dispensing an ultraviolet (UV) curable material onto a substrate; and a UV radiation source assembly coupled to the dispenser and operable to facilitate curing the UV curable material that has been dispensed onto the substrate, wherein the UV radiation source assembly comprises:

a UV radiation source; and an optical element, wherein the optical element is a lens with a planar surface that faces the substrate and a convex surface that faces away from the substrate, wherein the lens has an optical axis that lies in a plane that is perpendicular to a direction that the substrate moves relative to the dispenser and relative to the UV radiation source assembly, wherein the UV radiation source is off-set relative to the optical axis of the optical element to cause at least a portion of the UV radiation from the UV radiation source to pass through, and exit the optical element at an angle, such that any of the UV radiation that exits the optical element at the angle and ends up being reflected off the substrate will be directed away from the dispenser in a direction that the substrate moves relative to the dispenser and the UV radiation source assembly during system operation.

2. The system of claim 1, wherein the UV radiation source has a first optical axis, wherein the optical axis of the optical element is substantially perpendicular to the substrate upon which the UV curable material gets dispensed, and the first optical axis is disposed at an angle relative to the optical axis of the optical element, wherein at least a substantial portion of any backscatter radiation reflected off the substrate will be directed away from the UV curable material at a dispenser nozzle of the dispenser.

3. The system of claim 2, wherein the angle is between about 5 degrees and 50 degrees.

4. The system of claim 1, wherein the dispenser and the UV radiation source assembly are configured to move together relative to the substrate.

5. The system of claim 1, wherein the UV radiation source assembly further comprises:

a housing, wherein the UV radiation source is inside the housing and a portion of the optical element is exposed at an opening in the housing and an entirety of the exposed portion of the optical element is substantially flat.

6. The system of claim 5, wherein the entirety of the exposed portion of the optical element faces and is substantially parallel to the substrate.

7. The system of claim 1, wherein the UV radiation source assembly further comprises:

a reflector to guide the UV radiation produced by the UV radiation source to the optical element.

8. The system of claim 7, wherein the reflector defines and substantially surrounds a UV radiation path from the UV radiation source to the optical element, and wherein the reflector is shaped as an asymmetrical, truncated cone, with a narrower end of the asymmetrical, truncated cone forming a top of the reflector near the UV radiation source and a wider end of the asymmetrical, truncated cone near the lens.

9. The system of claim 1, wherein the UV radiation source assembly further comprises:

a mounting board having a surface that is disposed at an angle other than parallel to a surface of the substrate where the dispenser dispenses the UV curable material, wherein the UV radiation source is mounted on the angled surface of the mounting board, and wherein the surface of the mounting board, upon which the UV radiation source is mounted, is angled toward a direction opposite from a direction toward the dispenser.

10. The system of claim 9, further comprising a heat sink, with a plurality of fins, thermally coupled to the UV radiation source, wherein all of the fins of the heat sink extend away from the mounting board in a direction that is not perpendicular to the angled surface where the UV radiation source is mounted, and wherein all of the fins of the heat sink are parallel to one another.

11. The system of claim 10, wherein the UV radiation source assembly further comprises:

a housing with a side wall, wherein the fins of the heat sink are substantially parallel to the side wall.

12. The system of claim 10, wherein each fin of the heat sink has a different length than all of the other fins of the heat sink.

13. The system of claim 12, wherein the fins become progressively longer from a first end of the heat sink to a second end of the heat sink.

14. The system of claim 9, further comprising a heat sink, with a plurality of fins, thermally coupled to the UV radiation source, wherein each of the fins is trapezoidal, and extends away from the mounting board in a direction that is substantially parallel to the optical axis of the optical element, and wherein each fin becomes progressively longer from a first end of the fin to a second end of the fin.

15. The system of claim 1, further comprising:

a surface to support the substrate while the dispenser dispenses the UV curable material onto the substrate and while the UV radiation source assembly cures the UV curable material on the substrate.

16. A dispensing and ultraviolet (UV) curing system with low backscatter, the system comprising:

a dispenser for dispensing an ultraviolet (UV) curable material onto a substrate; and a UV radiation source assembly coupled to the dispenser and operable to facilitate curing the UV curable material that has been dispensed onto the substrate, wherein the dispenser and the UV radiation source assembly are configured to move together relative to the substrate;

the UV radiation source assembly comprising:

a UV radiation source for producing UV radiation; and an optical element configured relative to the UV radiation source such that the UV radiation passes through the optical element before exiting the UV radiation source assembly, wherein the optical element is a lens with a planar surface that faces the substrate and a convex surface that faces away from the substrate, wherein the lens has an optical axis that lies in a plane that is perpendicular to a direction that the substrate moves relative to the dispenser and relative to the UV radiation source assembly;

a reflector configured to guide the UV radiation produced by the UV radiation source to the optical element;

wherein the UV radiation source is off-set relative to an optical axis of the optical element to cause at least a portion of the UV radiation from the UV radiation source to pass through and exit the optical element at an angle, such that any of the UV radiation that exits the optical element at the angle and ends up being reflected off the substrate will be directed away from the dispenser in a direction that the substrate moves relative to the dispenser and the UV radiation source assembly during system operation;

a mounting board having a surface that is disposed at an angle other than parallel relative to a surface of the substrate where the dispenser dispenses the UV curable material, wherein the UV radiation source is mounted on, and fully supported by, the angled surface of the mounting board and, wherein the angled surface is angled away from the dispenser; and a heat sink, with a plurality of fins, thermally coupled to the UV radiation source.

17. The system of claim 16, wherein the UV radiation source assembly further comprises:

a housing, wherein the UV radiation source is inside the housing and a portion of the optical element is exposed at an opening in the housing and an entirety of the exposed portion of the optical element is substantially flat, and wherein the entirety of the exposed portion of the optical element faces and is substantially parallel to the substrate.

18. The system of claim 16, wherein each of the fins of the heat sink extends away from the mounting board in a direction that is not perpendicular to the angled surface where the UV radiation source is mounted, wherein the UV radiation source assembly further comprises a housing with a side wall, wherein the fins of the heat sink are substantially parallel to the side wall, wherein each fin of the heat sink has a different length than all of the other fins of the heat sink, and wherein the fins become progressively longer from a first end of the heat sink to a second end of the heat sink.

19. The system of claim 16, wherein each of the fins of the heat sink is trapezoidal, and extends away from the mounting board in a direction that is substantially parallel to the optical axis of the optical element, and wherein each fin become progressively longer from a first end of the heat sink to a second end of the heat sink.

20. The system of claim 16, further comprising a surface to support the substrate while the dispenser dispenses the UV curable material onto the substrate and while the UV radiation source assembly cures the UV curable material dispensed on the substrate.

21. The system of claim 1, wherein any of the UV radiation that exits the optical element at the angle and ends up being reflected off the substrate will be directed to a side of the UV radiation source assembly opposite the dispenser.

22. The system of claim 1, wherein the UV radiation source has an optical axis that is not aligned with the optical axis of the optical element.

23. The system of claim 1, wherein the UV radiation source assembly is a surface emitting UV radiation source, and wherein an emission surface of the surface emitting UV radiation source is not normal to the optical axis of the optical element.

24. The system of claim 16, wherein the UV radiation source assembly is a surface emitting UV radiation source, and wherein an emission surface of the surface emitting UV radiation source is not normal to the optical axis of the optical element.

25. A dispensing and ultraviolet (UV) curing system with low backscatter, the system comprising:

a dispenser for dispensing an ultraviolet (UV)-curable material onto a substrate; and a UV radiation source assembly coupled to the dispenser and operable to facilitate curing any of the UV curable material that has been dispensed onto the substrate, wherein the UV radiation source assembly comprises:

a mounting board with a mounting surface that is angled toward a direction that is opposite the dispenser;

a UV radiation source coupled to and completely supported by the mounting surface of the mounting board;

an optical element, wherein the optical element is a lens with a planar surface that faces the substrate and convex surface that faces away from the substrate, wherein the lens has an optical axis that lies in a plane that is perpendicular to a direction that the substrate moves relative to the dispenser and relative to the UV radiation source assembly; and a reflector that defines and substantially surrounds a UV radiation path from the UV radiation source to the optical element, wherein the reflector has a first end that butts against the mounting surface and a second end, opposite the first, that touches the optical element, wherein the reflector is shaped as an asymmetrical, truncated cone, wherein the UV radiation source is offset relative to an optical axis of the optical element such that at least a portion of the UV radiation produced by the UV radiation source is directed by the reflector to pass through and exit the optical element an angle, such that any of the UV radiation that exits the optical element at the angle and ends up being reflected off the substrate will be directed to a side of the UV radiation source assembly opposite the dispenser and in a direction that the substrate moves relative to the dispenser and the UV radiation source assembly during system operation.

26. The system of claim 25, wherein the UV radiation source assembly is a surface emitting UV radiation source, and wherein an emission surface of the surface emitting UV radiation source is not normal to the optical axis of the optical element.

27. The system of claim 1, wherein the UV radiation source assembly, including the UV radiation source, is configured relative to the dispenser to prevent the radiation that is reflected off the substrate from reaching and curing any of the UV curable material being delivered by the dispenser before the UV curable material reaches the substrate.

28. The system of claim 1, wherein the dispenser is configured to drop the UV curable material onto a portion of the substrate disposed in a plane, and wherein both the dispenser and the UV radiation source assembly are above the plane.

29. A dispensing and ultraviolet (UV) curing system with low backscatter, the system comprising:

a surface for supporting a substrate;

a dispenser for dispensing an ultraviolet (UV) curable material onto the substrate on the surface, wherein the dispenser is above the surface and drops the UV curable material from a dispenser nozzle to dispense the UV curable material, such that the UV curable material falls a distance from the dispenser nozzle to the substrate under the influence of gravity; and a UV radiation source assembly coupled to the dispenser and operable to facilitate curing the UV curable material that has been dispensed onto the substrate, wherein the UV radiation source assembly is above the surface;

wherein the UV radiation source assembly comprises:

a UV radiation source;

a lens having a planar surface that faces the substrate and a convex surface that faces away from the substrate, wherein the lens has an optical axis that lies in a plane that is perpendicular to a direction that the substrate moves relative to the dispenser and relative to the UV radiation source assembly during system operation; and a reflector configured to guide UV radiation produced by the UV radiation source to the lens, wherein the reflector is shaped as an asymmetrical, truncated cone, with a narrower end of the asymmetrical, truncated cone forming a top of the reflector near the UV radiation source and a wider end of the asymmetrical, truncated cone near the lens, wherein the UV radiation source is physically located on a side of the plane that is closer to the dispenser and no portion of the UV radiation source touches or intersects with the optical axis or the plane, such that, during system operation, UV radiation from the UV radiation source passes through, and exits the lens at an angle, and all of the UV radiation that exits the lens at the angle and ends up being reflected off the substrate will be directed away from the dispenser in the direction that the substrate moves relative to the dispenser and relative to the UV radiation source assembly.

30. The system of claim 29, wherein the UV radiation source has an optical axis that extends in a direction that is 40 degrees to 85 degrees relative to a direction in which the substrate moves.

31. The system of claim 16, wherein the reflector is shaped as an asymmetrical, truncated cone, with a narrower end of the asymmetrical, truncated cone forming a top of the reflector near the UV radiation source and a wider end of the asymmetrical, truncated cone near the lens.

* * * * *